US007916159B2

(12) United States Patent
Shiomi

(10) Patent No.: US 7,916,159 B2
(45) Date of Patent: Mar. 29, 2011

(54) DRIVING DEVICE FOR DISPLAY PANEL, DISPLAY DEVICE INCLUDING THE DRIVING DEVICE, METHOD FOR DRIVING A DISPLAY PANEL, PROGRAM, AND STORAGE MEDIUM

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 979 days.

(21) Appl. No.: 11/720,071

(22) PCT Filed: Dec. 14, 2005

(86) PCT No.: PCT/JP2005/022978
§ 371 (c)(1),
(2), (4) Date: May 23, 2007

(87) PCT Pub. No.: WO2006/070603
PCT Pub. Date: Jul. 6, 2006

(65) Prior Publication Data

US 2008/0079755 A1 Apr. 3, 2008

(30) Foreign Application Priority Data

Dec. 27, 2004 (JP) ..... 2004-377835

(51) Int. Cl.
*G09G 5/10* (2006.01)
*G09G 5/02* (2006.01)

(52) U.S. Cl. ..... 345/690; 345/694

(58) Field of Classification Search ..... 345/690, 345/694, 600
See application file for complete search history.

(56) References Cited

U.S. PATENT DOCUMENTS 4,800,375 A 1/1989 Silverstein et al.
(Continued)

FOREIGN PATENT DOCUMENTS

JP 02-118521 A 5/1990
(Continued)

OTHER PUBLICATIONS

Brown Elliot, C.H. et al.; "Development of the PenTile Matric Color AMLCD Subpixel Architecture and Rendering Algorithms"; Journal of the Society for Information Display, 2003, vol. 11, Issue 1, pp. 89-98.

(Continued)

*Primary Examiner* — Kevin M Nguyen
(74) *Attorney, Agent, or Firm* — Keating & Bennett, LLP

(57) ABSTRACT

A display panel is the one in which a pixel composed of sub-pixels of red (R), green (G), blue (B), and at least one other color has two sub-pixels at least in a vertical scanning direction, and color filters are provided respectively corresponding to the sub-pixels. There are provided: an incoming signal interpolating section which interpolate each of pixels based on incoming color signal components of red (R), green (G), and blue (B) at least in a vertical scanning direction to generate interpolated RGB signals; a luminance signal converting section which converts color signals of interpolated sub-pixels, which are obtained from the incoming signal interpolating section, into luminance signals; an another color luminance component adding section which adds a luminance signal component of at least one other color on a basis of luminance signal components of colors of red (R), green (G), and blue (B), which components are outputted from the luminance signal converting section; and a luminance reallocating section which reallocates luminance signals of peripheral interpolated sub-pixels, for a color of each of the color filters corresponding to the sub-pixels, in accordance with output from the another color luminance component adding section.

22 Claims, 12 Drawing Sheets

U.S. PATENT DOCUMENTS

| | | | | |
|---|---|---|---|---|
| 6,400,413 | B1 * | 6/2002 | Miyake | 348/581 |
| 6,549,682 | B2 * | 4/2003 | Okada | 382/298 |
| 7,268,792 | B2 * | 9/2007 | Lee et al. | 345/694 |
| 2003/0011613 | A1 | 1/2003 | Booth, Jr. | |
| 2003/0085906 | A1 | 5/2003 | Elliott et al. | |
| 2003/0103058 | A1 | 6/2003 | Hellen Brown Elliott et al. | |
| 2004/0046725 | A1 * | 3/2004 | Lee | 345/88 |
| 2004/0051724 | A1 | 3/2004 | Elliott et al. | |
| 2004/0174389 | A1 * | 9/2004 | Ben-David et al. | 345/694 |
| 2005/0122294 | A1 | 6/2005 | Ben-David et al. | |
| 2005/0184998 | A1 | 8/2005 | Yang et al. | |
| 2005/0225562 | A1 | 10/2005 | Higgins et al. | |
| 2005/0225563 | A1 | 10/2005 | Brown Elliott et al. | |
| 2005/0225575 | A1 * | 10/2005 | Brown Elliott et al. | 345/694 |

FOREIGN PATENT DOCUMENTS

| | | | |
|---|---|---|---|
| JP | 05-266204 | A | 10/1993 |
| JP | 09-251160 | A | 9/1997 |
| JP | 2001-209047 | A | 8/2001 |
| JP | 2004-064579 | A | 2/2004 |
| JP | 2004-208339 | A | 7/2004 |
| WO | 00/67196 | A1 | 11/2000 |

OTHER PUBLICATIONS

Tsuda, Keimu; "CLAIRVOYANTE, Ekisho no Akarusa Up Teishohi Denryoku o Jitsugen suru Shin Gijutsu"; (online), Aug. 30, 2005, http://k-tai.impress.co.jp/cda/articel/news_toppage/25422.html.

Official Communication for PCT Application No. PCT/JP2005/022978; mailed on Mar. 14, 2006.

Tsuda, Keimu; "CLAIRVOYANTE's New Technology for Brighter and Low-Power Liquid"; (online), Aug. 30, 2005, http://k-tai.impress.co.jp/cda/article/news_toppage/25422.html.

* cited by examiner

ORIGINAL IMAGE

LOW FREQUENCY IMAGE

HIGH FREQUENCY IMAGE

UPSAMPLING

FIG. 12 (a)

| | |
|---|---|
| R | Y |
| B | G |

FIG. 12 (b)

| | | | |
|---|---|---|---|
| R | Y | B | G |
| B | G | R | Y |
| R | Y | B | G |
| B | G | R | Y |

FIG. 13 (a)

| | |
|---|---|
| R | CN |
| B | G |

FIG. 13 (b)

| | | | |
|---|---|---|---|
| R | CN | B | G |
| B | G | R | CN |
| R | CN | B | G |
| B | G | R | CN |

FIG. 14 (a)

| | |
|---|---|
| R | M |
| B | G |

FIG. 14 (b)

| | | | |
|---|---|---|---|
| R | M | B | G |
| B | G | R | M |
| R | M | B | G |
| B | G | R | M |

FIG. 15 (a)

| | | |
|---|---|---|
| R | G | B |
| Y | W | CN |

FIG. 15 (d)

| | | |
|---|---|---|
| Y | B | G |
| R | W | CN |

FIG. 15 (b)

| | | |
|---|---|---|
| Y | W | CN |
| R | G | B |

FIG. 15 (e)

| | | |
|---|---|---|
| R | W | Y |
| CN | B | G |

FIG. 15 (c)

| | | |
|---|---|---|
| R | W | CN |
| Y | B | G |

FIG. 15 (f)

| | | |
|---|---|---|
| CN | B | G |
| R | W | Y |

FIG. 16 (a)

| | | | | | |
|---|---|---|---|---|---|
| R | G | B | R | G | B |
| Y | W | CN | Y | W | CN |
| R | G | B | R | G | B |
| Y | W | CN | Y | W | CN |

FIG. 16 (b)

| | | | | | |
|---|---|---|---|---|---|
| R | G | B | Y | W | CN |
| Y | W | CN | R | G | B |
| R | G | B | Y | W | CN |
| Y | W | CN | R | G | B |

FIG. 16 (c)

| | | | | | |
|---|---|---|---|---|---|
| R | W | CN | R | W | CN |
| Y | B | G | Y | B | G |
| R | W | CN | R | W | CN |
| Y | B | G | Y | B | G |

FIG. 16 (d)

| | | | | | |
|---|---|---|---|---|---|
| R | W | CN | Y | B | G |
| Y | B | G | R | W | CN |
| R | W | CN | Y | B | G |
| Y | B | G | R | W | CN |

FIG. 16 (e)

| | | | | | |
|---|---|---|---|---|---|
| R | W | Y | R | W | Y |
| CN | B | G | CN | B | G |
| R | W | Y | R | W | Y |
| CN | B | G | CN | B | G |

FIG. 16 (f)

| | | | | | |
|---|---|---|---|---|---|
| R | W | Y | CN | B | G |
| CN | B | G | R | W | Y |
| R | W | Y | CN | B | G |
| CN | B | G | R | W | Y |

DRIVING DEVICE FOR DISPLAY PANEL, DISPLAY DEVICE INCLUDING THE DRIVING DEVICE, METHOD FOR DRIVING A DISPLAY PANEL, PROGRAM, AND STORAGE MEDIUM

BACKGROUND OF THE INVENTION

1. Field of the Invention

The present invention relates to (i) a driving device for a display panel in which a pixel composed of sub-pixels of red (R), green (G), blue (B), and at least one other color has a plurality of sub-pixels at least in a vertical scanning direction, and color filters are provided corresponding to the respective sub-pixels, and (ii) a display device including the driving device.

2. Description of the Related Art

As disclosed in Japanese Unexamined Patent Publication No. 118521/1990 (Tokukaihei 2-118521; published on May 2, 1990), for example, the conventional liquid crystal display devices have blocks of color filters arranged in a pattern of locations for the increase of luminance. Each of the blocks is composed, as a unit block, of a color filter of white (W) as well as color filters of red (R), green (G), and blue (B). More specifically, in the liquid crystal display devices, white light is emitted from a backlight such as a fluorescent lamp, for example, passes through liquid crystal to change its transmittance. Then, the white light passes through the color filters of red (R), green (G), and blue (B), whereby a color image is recognized by human eyes. The light having passed through the color filters of red (R), green (G), and blue (B) reduces a considerable amount of luminance. For that reason, by adding the color filter of white (W) to one block, it is possible to increase luminance of light emitted by one block.

As illustrated in FIG. 17, Patent Document 1 mentioned above adopts a 2-by-2 sub-pixel matrix pattern as a pattern of colors red (R), green (G), blue (B), and white (W). The 2-by-2 sub-pixel matrix pattern is arranged such that blocks, each of which is composed of red (R), blue (B), white (W), and green (G) in this order counterclockwise, are arranged in a matrix manner.

Assume that one block, i.e. one pixel composed of sub-pixels of red (R), green (G), blue (B) outputs luminance of 1 in the conventional arrangement. On the contrary, a block composed of sub-pixels of red (R), green (G), blue (B), and white (W) arranged in a matrix manner obtains a total luminance of $(3/4)\times1+(1/4)\times3=3/2$. This is because luminance of ¾ is obtained from the three sub-pixels of red (R), green (G), and blue (B), which occupy ¾ area of one pixel, and luminance of 3 is obtained from the sub-pixel of white (W), which occupies ¼ area of one pixel. This makes it possible to realize luminance increase of approximately 50% per pixel as a whole.

Another example of the pattern includes a stripe layout pattern illustrated in FIG. 18 and a 2-by-2 pixel matrix pattern as illustrated in FIG. 19. In the 2-by-2 pixel matrix pattern, four pixels constituting one block are arranged in a matrix manner.

In a color filter 100 arranged in the 2-by-2 pixel matrix pattern, pixel (1,1) and pixel (2,1) each has red (R), blue (B), green (G), and white (W) in this order counterclockwise, whereas pixel (1,2) and pixel (2,2) each has blue (B), red (R), white (W), and green (G) in this order counterclockwise. Such a pixel arrangement is made for the following reason:

That is, white (W) generally contributes to luminance only. Among red (R), green (G), and blue (B), green (G) contributes to luminance most, followed by red (R) and blue (B). Red (R), green (G), and blue (B) contribute to hue equally. Meanwhile, there is the fact that a human is sensitive to luminance and able to recognize even a slight variation of luminance, but is not able to recognize slight variation of hue.

Thus, if four pixels are arranged per block in consideration of luminance balance that is important for a human, the above-mentioned 2-by-2 pixel matrix pattern is obtained, for example.

However, (i) a driving device for a liquid crystal display panel including color filters arranged in the conventional matrix pattern of 2-by-2 sub-pixels and (ii) a liquid crystal display device including the driving device have the following problem. That is, it is difficult to respond to, for example, scale change of a screen or other event because incoming signals are in one-to-one correspondence with display outputs. As a result, it is difficult to respond to scale change, especially scale change in a longitudinal direction, as in the present situation.

For example, the number of effective scanning lines of a typical television is currently 480, whereas the number of effective scanning lines of a digital high-definition television is 1080. Under the circumstances, a typical television cannot display an image corresponding to video signals having 480 or more effective scanning lines, with a resolution determined by the video signals.

Further, video image corresponding to even 480 lines of TV data can be displayed on a display device with a higher degree of definition than its original video image if the display device has a capability of displaying, for example, 960 lines of data, which is twice as much as 480 lines of TV data. This is not limited in a case where scale change is not performed. Deterioration of image that can occur due to video format change to 720 lines, 1080 lines, or other number of lines can be minimized if there is a device capable of high-definition display.

Interpolation of one pixel for improvement in resolution is disclosed in Japanese Unexamined Patent Publication No. 64579/2004 (Tokukai 2004-64579; published on Feb. 26, 2004) and Japanese Unexamined Patent Publication No. 208339/2004 (Tokukai 2004-208339; published on Jul. 22, 2004), for example. Both cases assume a stripe pattern and fail to disclose a displaying method that places importance on luminance improvement, luminance balance, and color center. In other words, there is no structure for a resolution which allows for display of interpolated information and is higher than a resolution determined by incoming signals, in the stripe pattern. That is why it is impossible to provide means displaying an interpolated high-definition image. On the contrary, color filters arranged in a matrix pattern of 2-by-2 sub-pixels per pixel has the potential to perform display with a high resolution, which is, however, complex and is not easy.

SUMMARY OF THE INVENTION

In order to overcome the problems described above, preferred embodiments of the present invention provide (i) a driving device for a display panel which is capable of subjecting video signals to signal processing preferably via software for suitable display in order to improve resolution without change of the current arrangement of color filters, (ii) a display device including the driving device, (iii) a method for driving a display panel, (iv) a program, and (v) a storage medium.

In order to solve the above-described problems, a driving device for a display panel according to a preferred embodiment of the present invention is a driving device for a display panel in which a pixel composed of sub-pixels of red (R), green (G), blue (B), and at least one other color has a plurality of sub-pixels at least in a vertical scanning direction, and color filters are provided corresponding to the respective sub-pixels, the driving device including: an incoming signal interpolating section which interpolate each of the sub-pixels based on incoming color signal components of red (R), green (G), and blue (B) at least in a vertical scanning direction to generate interpolated RGB signals; a luminance signal converting section which converts color signals of interpolated sub-pixels, which are obtained from the incoming signal interpolating section, into luminance signals; a color luminance component adding section which adds a luminance signal component of at least one other color on a basis of luminance signal components of colors of red (R), green (G), and blue (B), which components are outputted from the luminance signal converting section; and a luminance reallocating section which reallocates luminance signals of peripheral interpolated sub-pixels, for a color of each of the color filters corresponding to the sub-pixels, in accordance with output from the color luminance component adding section. Note that the incoming signal interpolating section interpolates each pixel at least in the vertical scanning direction, which means that preferred embodiments of the present invention include not only interpolation in the vertical scanning direction but also interpolation in the horizontal scanning direction.

In order to solve the above problems, a method for driving a display panel according to a preferred embodiment of the present invention is a method for driving a display panel in which a pixel composed of sub-pixels of red (R), green (G), blue (B), and at least one other color has a plurality of sub-pixels at least in a vertical scanning direction, and color filters are provided corresponding to the respective sub-pixels, the method including: incoming signal interpolating step of interpolating each of the sub-pixels based on incoming color signal components of red (R), green (G), and blue (B) at least in a vertical scanning direction to generate interpolated RGB signals; luminance signal converting step of converting color signals of interpolated sub-pixels, which are obtained in the incoming signal interpolating step, into luminance signals; a color luminance component adding step of adding a luminance signal component of at least one other color on a basis of luminance signal components of colors of red (R), green (G), and blue (B), which are obtained as the luminance signals in the luminance signal converting step; and luminance reallocating step of reallocating luminance signals of peripheral interpolated sub-pixels for a color of each of the color filters corresponding to the sub-pixels, after the color luminance component adding step.

According to the above-described preferred embodiment of the present invention, the incoming signal interpolating section interpolates each of the sub-pixels based on incoming color signal components of red (R), green (G), and blue (B) at least in the vertical scanning direction to generate interpolated RGB signals. Therefore, resolution of the incoming signals improves. The color signals of the interpolated sub-pixels, which are obtained from the incoming signal interpolating section, are converted into luminance signals by the luminance signal converting section. Further, the color luminance component adding section which adds a luminance signal component of at least one other color on a basis of luminance signal components of colors of red (R), green (G), and blue (B), which components are outputted from the luminance signal converting section.

Various preferred embodiments of the present invention have virtual interpolated color spaces for the color signals of the interpolated sub-pixels in performing signal processing. The present embodiment is arranged such that one pixel composed of sub-pixels of red (R), green (G), blue (B), and at least one other color has a plurality of sub-pixels at least in the vertical scanning direction, and the color filters are provided corresponding to the sub-pixels.

This creates a problem of how to allocate the color signals of the interpolated sub-pixels for display to the color filters corresponding to the sub-pixels. The preferred embodiments of the present invention solve this problem by providing the luminance reallocating section. The luminance reallocating section reallocates the luminance signals of the peripheral interpolated sub-pixels for a color of each of the color filters corresponding to the sub-pixels, in accordance with output from the color luminance component adding section.

As a result of this, it is possible to display the color signals of the interpolated sub-pixels for a color of each of the color filters corresponding to the sub-pixels.

Thus, it is possible to provide (i) a driving device for a display panel which is capable of subjecting video signals to signal processing preferably via software for suitable display in order to improve resolution without changing the current arrangement of color filters, (ii) a display device including the driving device, and (iii) a method for driving a display panel.

Additional elements, characteristics, steps, features, advantages and strengths of the present invention will be made clear by the following description of preferred embodiments thereof with reference to the drawings.

BRIEF DESCRIPTION OF DRAWINGS

FIG. 6(*b*) is an explanatory view illustrating, in one dimension, the principle of interpolation in a twofold interpolation method in the driving device for a display panel.

FIG. 7(*b*) is an explanatory view illustrating, in one dimension, the nearest neighbor method of twofold interpolation methods in the driving device for a display panel.

FIG. 8(*b*) is an explanatory view illustrating, in one dimension, the linear interpolation method of twofold interpolation methods in the driving device for a display panel.

FIG. 10(*b*) is an explanatory view illustrating the cosine transformation method of twofold interpolation methods in the driving device for a display panel.

FIG. 10(*c*) is an explanatory view illustrating the cosine transformation method of twofold interpolation methods in the driving device for a display panel.

FIG. 10(*d*) is an explanatory view illustrating the cosine transformation method of twofold interpolation methods in the driving device for a display panel.

FIG. 11(*b*) is an explanatory view illustrating a method using the Laplacian transformation of twofold interpolation methods in the driving device for a display panel and illustrating a low frequency image and a high frequency image.

FIG. 11(*c*) is an explanatory view illustrating a method using the Laplacian transformation of twofold interpolation methods in the driving device for a display panel and illustrating upsampling.

FIG. 12(*a*) is a plan view illustrating color filters provided corresponding to sub-pixels of red (R), green (G), blue (B), and yellow (Y) in one block corresponding to one pixel in which sub-pixels are arranged in a matrix pattern of 2-by-2 sub-pixels.

FIG. 12(*b*) is a plan view illustrating color filters for four pixels which are arranged in one block in a matrix pattern of 2-by-2 pixels by combining the block illustrated in FIG. 12(*a*) with three other blocks.

FIG. 13(*a*) is a plan view illustrating color filters provided corresponding to sub-pixels of red (R), green (G), blue (B), and cyan (CN) in one block corresponding to one pixel in which sub-pixels are arranged in a matrix pattern of 2-by-2 sub-pixels.

FIG. 13(*b*) is a plan view illustrating color filters for four pixels which are arranged in one block in a matrix pattern of 2-by-2 pixels by combining the block illustrated in FIG. 13(*a*) with three other blocks.

FIG. 14(*a*) is a plan view illustrating color filters provided corresponding to sub-pixels of red (R), green (G), blue (B), and magenta (CN) in one block corresponding to one pixel in which sub-pixels are arranged in a matrix pattern of 2-by-2 sub-pixels.

FIG. 14(*b*) is a plan view illustrating color filters for four pixels which are arranged in one block in a matrix pattern of 2-by-2 pixels by combining the block illustrated in FIG. 14(*a*) with three other blocks.

FIG. 15(*a*) is a plan view illustrating color filters in one block corresponding to one pixel in which sub-pixels are arranged in a matrix pattern of 2-by-3 sub-pixels.

FIG. 15(*b*) is a plan view illustrating another example of color filters in one block corresponding to one pixel in which sub-pixels are arranged in a matrix pattern of 2-by-3 sub-pixels.

FIG. 15(*c*) is a plan view illustrating still another example of color filters in one block corresponding to one pixel in which sub-pixels are arranged in a matrix pattern of 2-by-3 sub-pixels.

FIG. 15(*d*) is a plan view illustrating yet another example of color filters in one block corresponding to one pixel in which sub-pixels are arranged in a matrix pattern of 2-by-3 sub-pixels.

FIG. 15(*e*) is a plan view illustrating still another example of color filters in one block corresponding to one pixel in which sub-pixels are arranged in a matrix pattern of 2-by-3 sub-pixels.

FIG. 15(*f*) is a plan view illustrating yet another example of color filters in one block corresponding to one pixel in which sub-pixels are arranged in a matrix pattern of 2-by-3 sub-pixels.

FIG. 16(*a*) is a plan view illustrating color filters for four pixels which are arranged in one block in a matrix pattern of 2-by-2 pixels by combining the block illustrated in FIG. 15(*a*) with three other blocks.

FIG. 16(*b*) is a plan view illustrating color filters for four pixels which are arranged in one block in a matrix pattern of 2-by-2 pixels by combining the block illustrated in FIG. 15(*b*) with three other blocks.

FIG. 16(*c*) is a plan view illustrating color filters for four pixels which are arranged in one block in a matrix pattern of 2-by-2 pixels by combining the block illustrated in FIG. 15(*c*) with three other blocks.

FIG. 16(*d*) is a plan view illustrating color filters for four pixels which are arranged in one block in a matrix pattern of 2-by-2 pixels by combining the block illustrated in FIG. 15(*d*) with three other blocks.

FIG. 16(*e*) is a plan view illustrating color filters for four pixels which are arranged in one block in a matrix pattern of 2-by-2 pixels by combining the block illustrated in FIG. 15(*c*) with three other blocks.

FIG. 16(*f*) is a plan view illustrating color filters for four pixels which are arranged in one block in a matrix pattern of 2-by-2 pixels by combining the block illustrated in FIG. 15(*d*) with three other blocks.

DETAILED DESCRIPTION OF PREFERRED EMBODIMENTS

The following will describe preferred embodiments of the present invention with reference to FIGS. 1 through 16.

Figure 2:
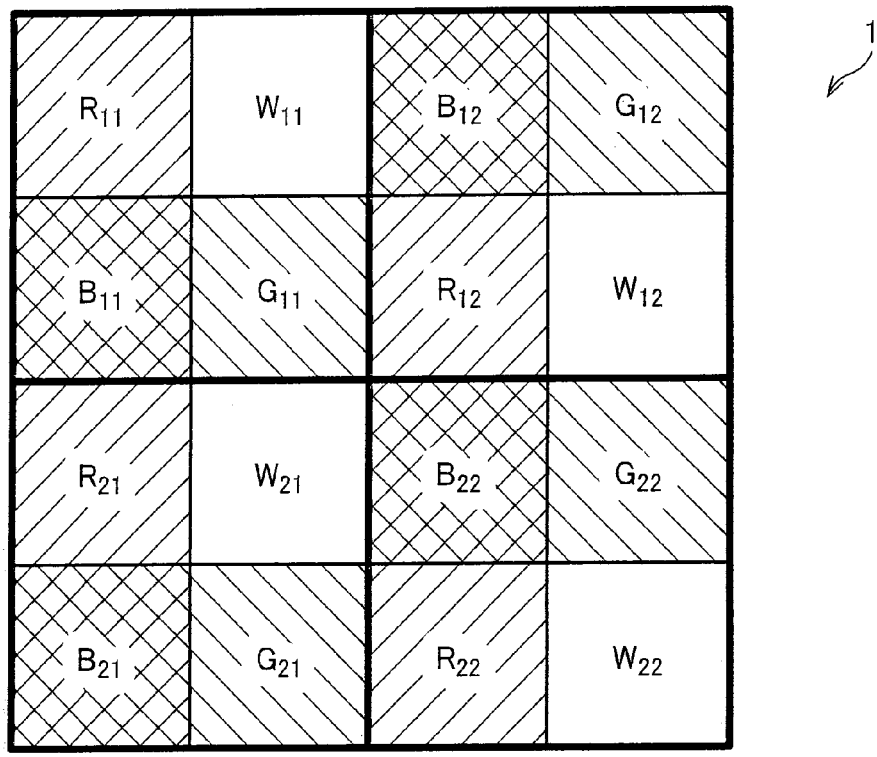
FIG. 2 is a plan view illustrating the arrangement of color filters on the display panel in which four pixels, each of which is composed of four sub-pixels of red (R), green (G), blue (B), and white (W), are arranged in a matrix pattern of 2-by-2 pixels per block.

In a driving device for a display panel according to the present preferred embodiment and a display device including the driving device, a color filter is made for four pixels, each of which is composed of four sub-pixels of red (R), green (G), blue (B), and white (W), being arranged in a matrix pattern of 2-by-2 pixels per block, as illustrated in FIG. 2.

More specifically, in a color filter 1 of the present preferred embodiment, pixel (1,1) and pixel (2,1) each has red (R), blue (B), green (G), and white (W) in this order counterclockwise, whereas pixel (1,2) and pixel (2,2) each has blue (B), red (R), white (W), and green (G) in this order counterclockwise. Such combinations of four pixels per block realize a pattern of the color filter 1 that places importance on luminance balance.

Figure 1:
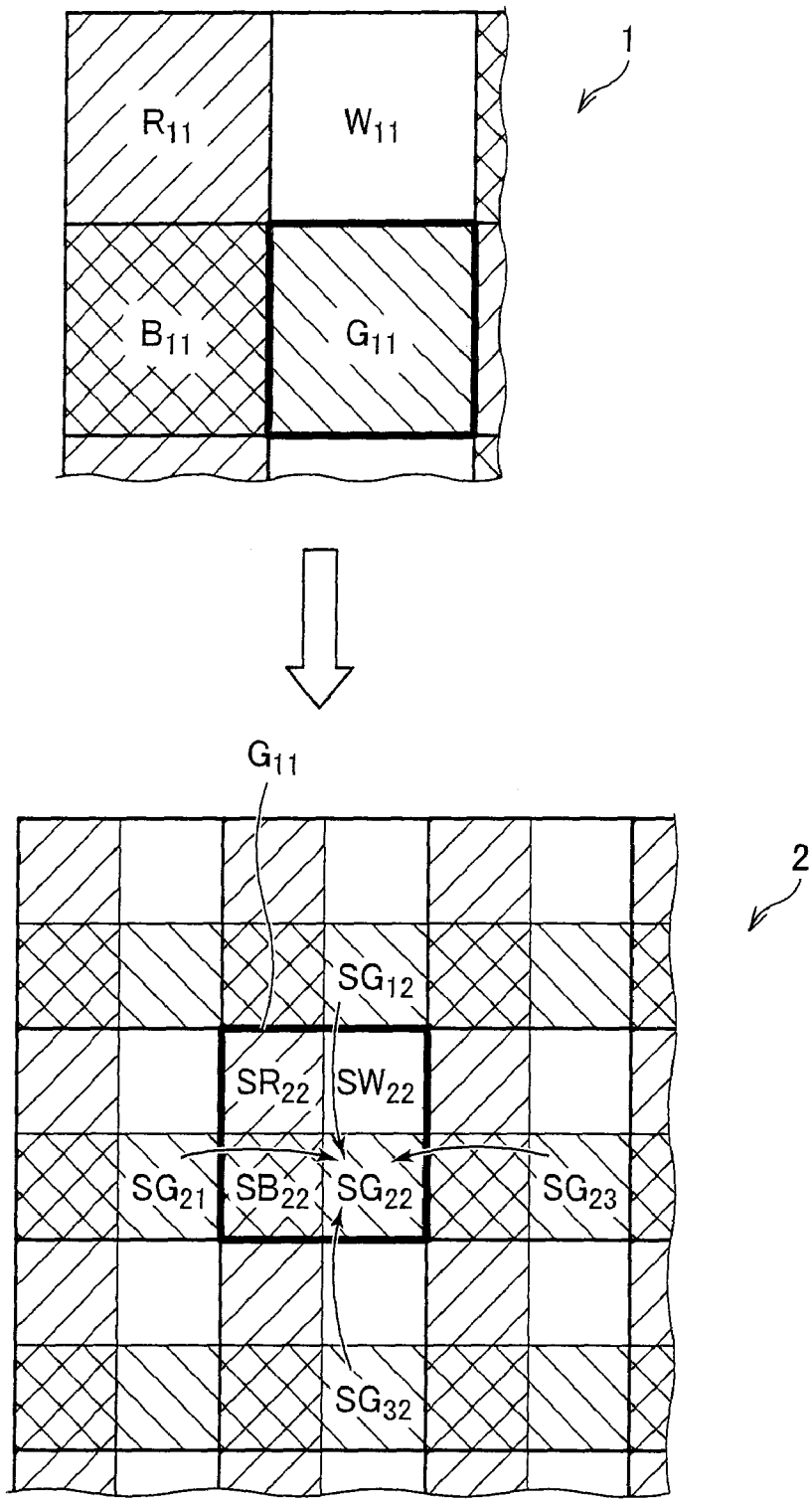
FIG. 1 is an explanatory view illustrating color repositioning performed by a virtual signal generating section of a driving device for a display panel according to a preferred embodiment of the present invention.
Figure 3:
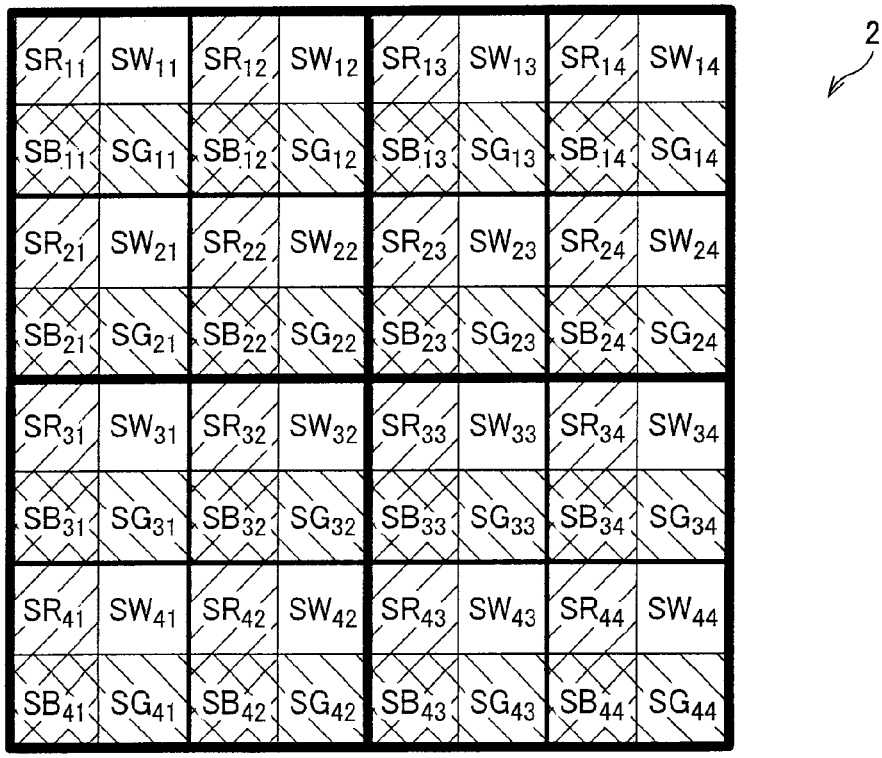
FIG. 3 is a plan view illustrating the arrangement of an interpolated sub-pixel space in color filters for four pixels arranged in a matrix pattern of 2-by-2 pixels, on the display panel which is subjected to twofold interpolation in a vertical scanning direction and a horizontal scanning direction by a twofold interpolating section of the driving device.

Incidentally, in the present preferred embodiment, in displaying an incoming signal on a liquid crystal display panel having the color filter 1, signal processing in which the incoming signal is subjected to twofold interpolation is performed for a higher degree of resolution and a higher degree of flexibility in response to scale change and other operation. As a result of this, a virtual interpolated sub-pixel space 2 as illustrated in FIG. 3 is generated to perform display in a matrix pattern of red (R), blue (B), green (G), and white (W) in this order counterclockwise in each interpolated sub-pixel (m, n). Assume that, as illustrated in FIG. 1, for example, G(1,1), which is a sub-pixel of green (G) of a matrix (1,1) in a 2×2 pixel matrix, is a filter of green (G). In this case, there arises the issue of how to process luminance signals corresponding to red (R), blue (B), green (G), and white (W), for the filter of green (G).

In the present embodiment, luminance signals of peripheral pixels are reallocated, for example, as follows:

$$G(1,1)=SG(2,2)/2+(SG(2,1)+SG(1,2)+SG(3,2)+SG(2,3))/8$$

More specifically, in the present preferred embodiment, for example, an interpolated sub-pixel G(2,2), which is of the same color as a color filter of the sub-pixel G(1,1), is caused to have ½ of luminance, and its peripheral sub-pixels, i.e. interpolated sub-pixel G(2,1), interpolated sub-pixel G(1,2), interpolated sub-pixel G(3,2), and interpolated sub-pixel G(2,3) are caused to have ⅛ of luminance for each. As a result of addition of these luminance values, luminance value of green (G) is 1 as a whole. Accordingly, interpolated sub-pixel R(2,2), interpolated sub-pixel B(2,2), and interpolated sub-pixel W(2,2), which are located in a color filter of sub-pixel G(1,1), each allocates ⅛ of luminance to each of the respective peripheral pixels in all directions. Luminance values of the interpolated sub-pixel R(2,2), the interpolated sub-pixel B(2,2), and the interpolated sub-pixel W(2,2) are virtually 0.

Thus, by reallocating luminance signals for the peripheral sub-pixels in the incoming video signals in consideration of color center on the color filter 1, it is possible to apparently multiply display resolution by a factor of approximately 1.5 to 2.

Figure 4:
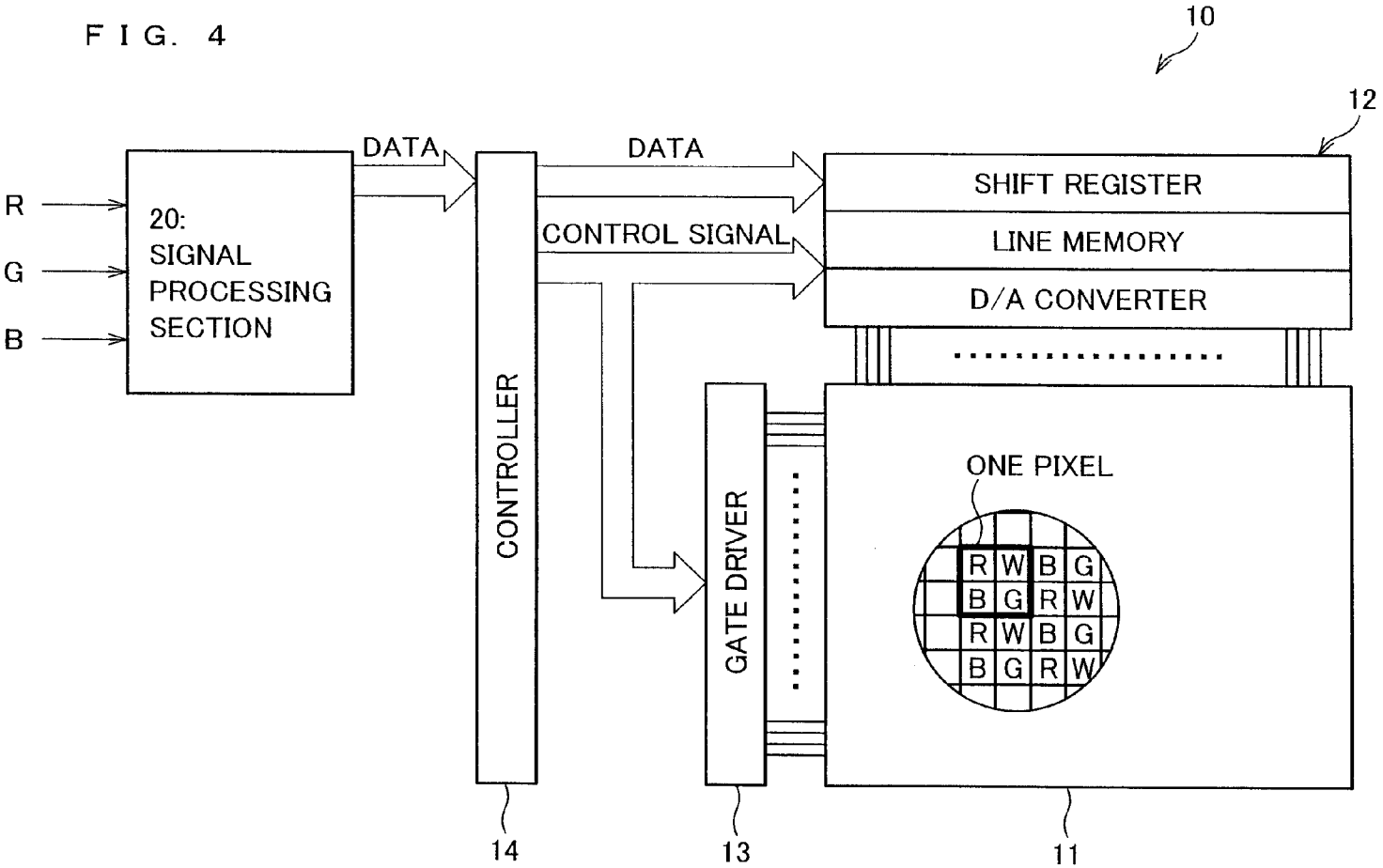
FIG. 4 is a block diagram illustrating the structure of the driving device.

As illustrated in FIG. 4, a liquid crystal display device which drives the above liquid crystal display panel includes: a liquid crystal display panel 11 as a display panel; a source driver 12 including a shift register, a line memory, and a D/A converter; a gate driver 13; a controller 14; and a signal processing section 20 to which signals of red (R), green (G), and blue (B) are supplied. Note that all the elements except for the liquid crystal display panel 11 constitute a driving device 10 for a display panel according to a preferred embodiment of the present invention.

Figure 5:
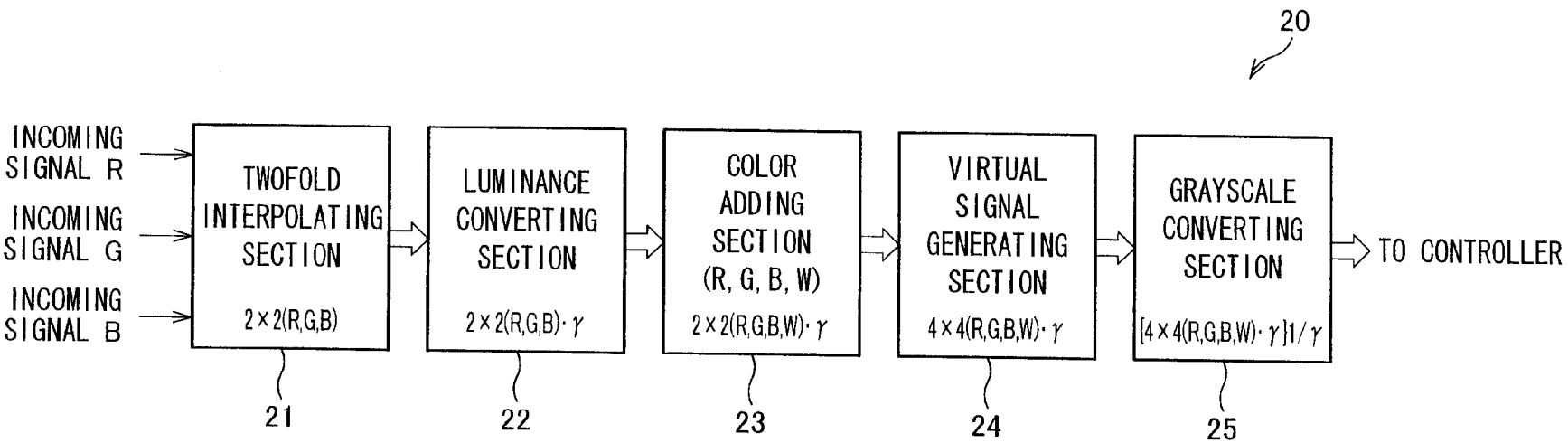
FIG. 5 is a block diagram illustrating the structure of a signal processing section of the driving device.

As illustrated in FIG. 5, the signal processing section 20 includes: a twofold interpolating section 21 defining an incoming signal interpolating unit; a luminance converting section 22 defining a luminance signal converter; a color adding section 23 defining a color component adding unit; a virtual signal generating section 24 defining a luminance reallocating unit; and a grayscale converting section 25.

The twofold interpolating section 21 subjects incoming signals RGB, of a video signal to twofold interpolation to output twofold-interpolated signals. Although twofold interpolation is adopted in the present preferred embodiment, this is not the only possibility. Alternatively, interpolation of threefold or more may be adopted.

Now, twofold interpolation method is discussed with reference to FIGS. 6 through 11.

Figure 6:
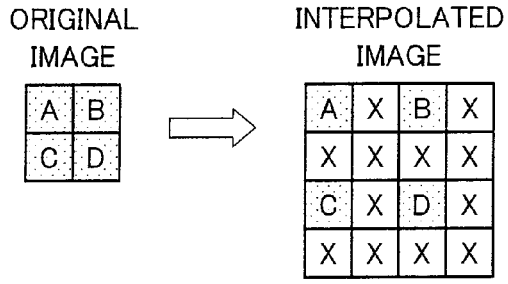
FIG. 6(*a*) is an explanatory view illustrating, by using images, the principle of interpolation in a twofold interpolation method in the driving device for a display panel.
Figure 6:
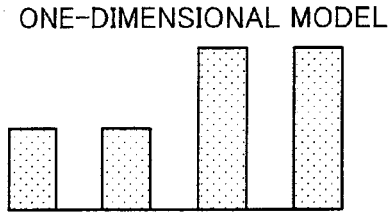

For example, assume a case that an original image of 2-by-2 dots is subjected to twofold interpolation to create an interpolated image of 4-by-4 dots, as illustrated in FIGS. 6(*a*) and 6(*b*). In this case, a method for estimating regions indicated by X is an interpolation method. Examples of the method for estimating the regions indicated by X include a nearest neighbor method, a linear interpolation method, a convolution interpolation method, a cosine transformation method, a method using Fourier transformation, and a method using Laplacian transformation, and other method.

Figure 7:
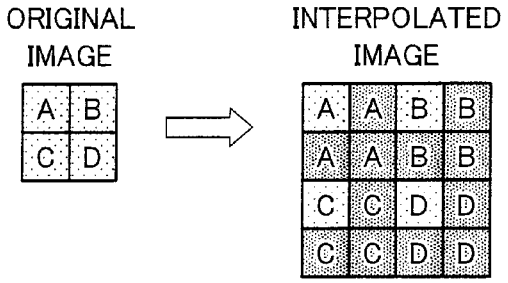
FIG. 7(*a*) is an explanatory view illustrating, by using images, the nearest neighbor method of twofold interpolation methods in the driving device for a display panel.
Figure 7:
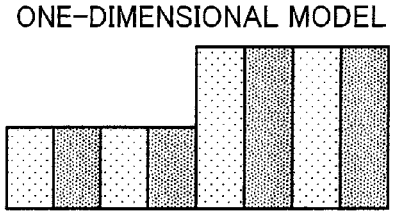

The nearest neighbor method, which is the simplest interpolation method, copies a dot which is the nearest to X just as it is, as illustrated in FIGS. 7(*a*) and 7(*b*). In this method, it is set in advance that either a left dot or an upper dot, for example, is adopted if a distance from the left dot is the same as a distance from the upper dot. This interpolation method, which is performed as if large tiles are laid without change in the amount of information, does not produce effects in the present embodiment. That is why this interpolation method is regarded as a comparative example.

Figure 8:
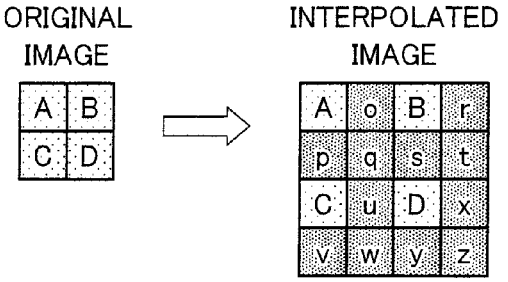
FIG. 8(*a*) is an explanatory view illustrating, by using images, the linear interpolation method of twofold interpolation methods in the driving device for a display panel.
Figure 8:
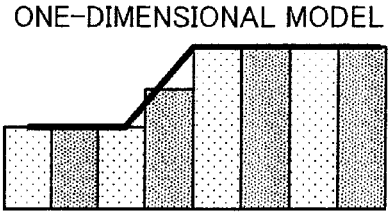

The linear interpolation method is the interpolation method in which the average of two to four dots around a target dot is taken, as illustrated in FIGS. 8(*a*) and 8(*b*). This interpolation method is adopted most often because it is simple and produces smooth edges and relatively good results. For example, this interpolation method performs the processing represented by the following equations:

$$o=(A+B)/2;$$

$$p=(A+C)/2; \text{ and}$$

$$q=(A+B+C+D)/4.$$

This method has the disadvantage that smooth edges are always produced and therefore appear to be indistinct.

Next, the convolution interpolation method is the method as an extension of the linear interpolation method. In this method, information of multiple dots (e.g. 16 dots) around an interpolation point is obtained by spline function fitting, for example. Note that this convolution interpolation method is often called cubic convolution interpolation because 3 is used for an order of a function.

Figure 9:
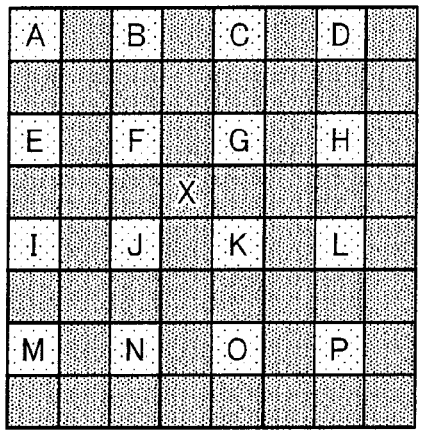
FIG. 9 is an explanatory view illustrating a convolution interpolation method of twofold interpolation methods in the driving device for a display panel.

In the convolution interpolation method, dot information A through P are used to obtain X, as illustrated in FIG. 9. This method is relatively common. However, this method has the disadvantage that it produces indistinct image, as in the linear interpolation method.

The linear interpolation method and the convolution interpolation method are relatively common. These methods can be adopted for the present preferred embodiment. In order to avoid loss of a high frequency component, a method to which frequency analysis is applied is also in fashion.

Figure 10:
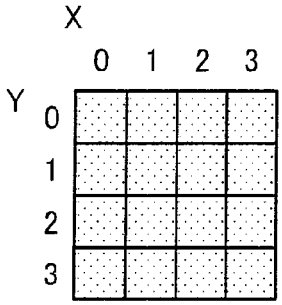
FIG. 10(*a*) is an explanatory view illustrating the cosine transformation method of twofold interpolation methods in the driving device for a display panel.
Figure 10:
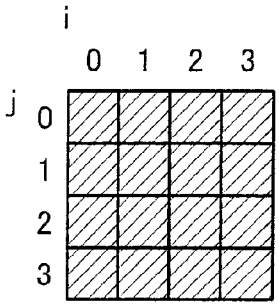
Figure 10:
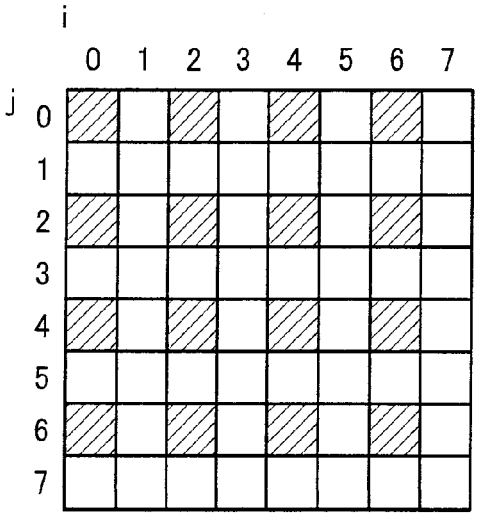
Figure 10:
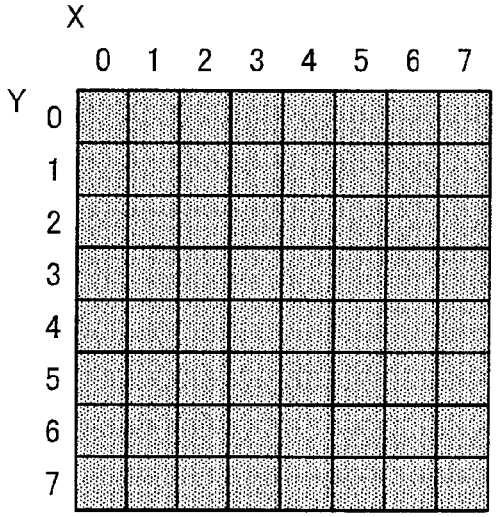

The cosine transformation method is in heavy use for JPEG and others. In the cosine transformation method, 8-by-8 dots, for example, are decomposed into frequency components, and the frequency components are expanded. For example, as illustrated in FIGS. 10(*a*) and 10(*b*), four frequency components in rows and columns are extracted from an original image of 4-by-4 dots. The four frequency components are expanded into eight frequency components in rows and columns, as illustrated in FIGS. 10(*c*) and 10(*d*). For the expansion, the linear interpolation method and the convolution interpolation method are used because a size and a frequency component are strongly correlated. Thereafter, an interpolated image of 8-by-8 dots is obtained by inverse cosine transformation. The advantage of this method is that an image of a certain level is obtained dot by dot. However, the disadvantage thereof is that it takes much time for processing. Note that many algorithms for time reduction are suggested.

The method using Fourier transformation is almost the same as the cosine transformation method, and the explanation thereof is omitted.

Figure 11:
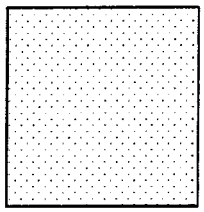
FIG. 11(*a*) is an explanatory view illustrating a method using the Laplacian transformation of twofold interpolation methods in the driving device for a display panel and illustrating an original image.
Figure 11:
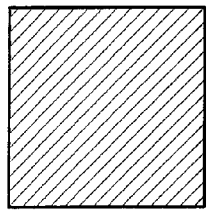
Figure 11:
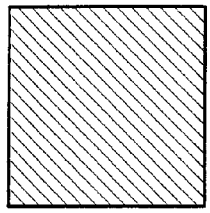
Figure 11:
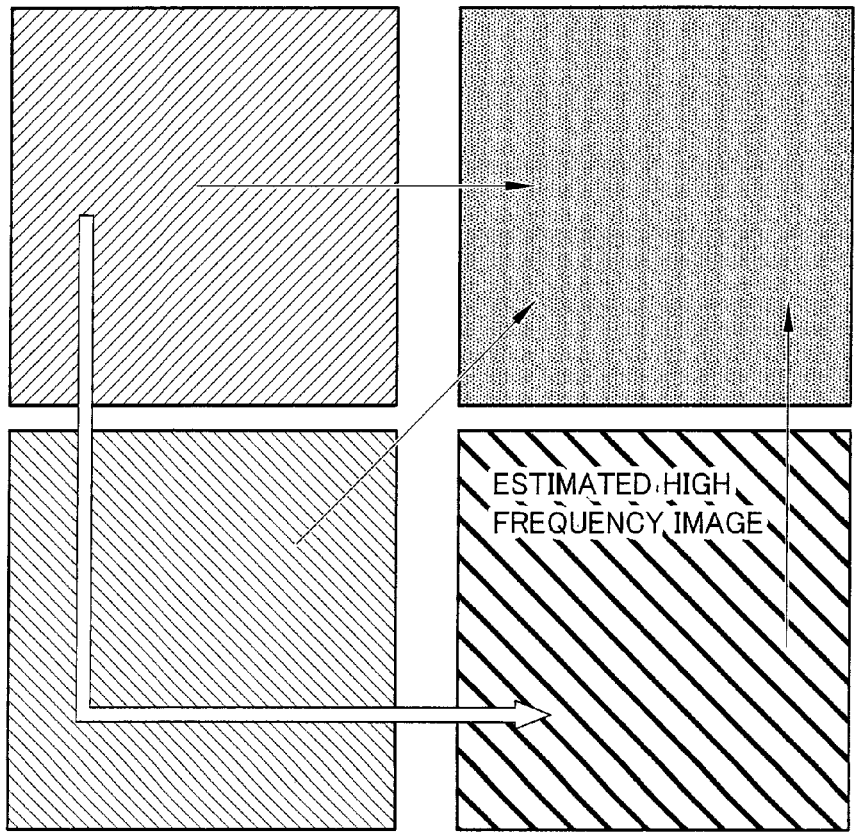
Figure 17:
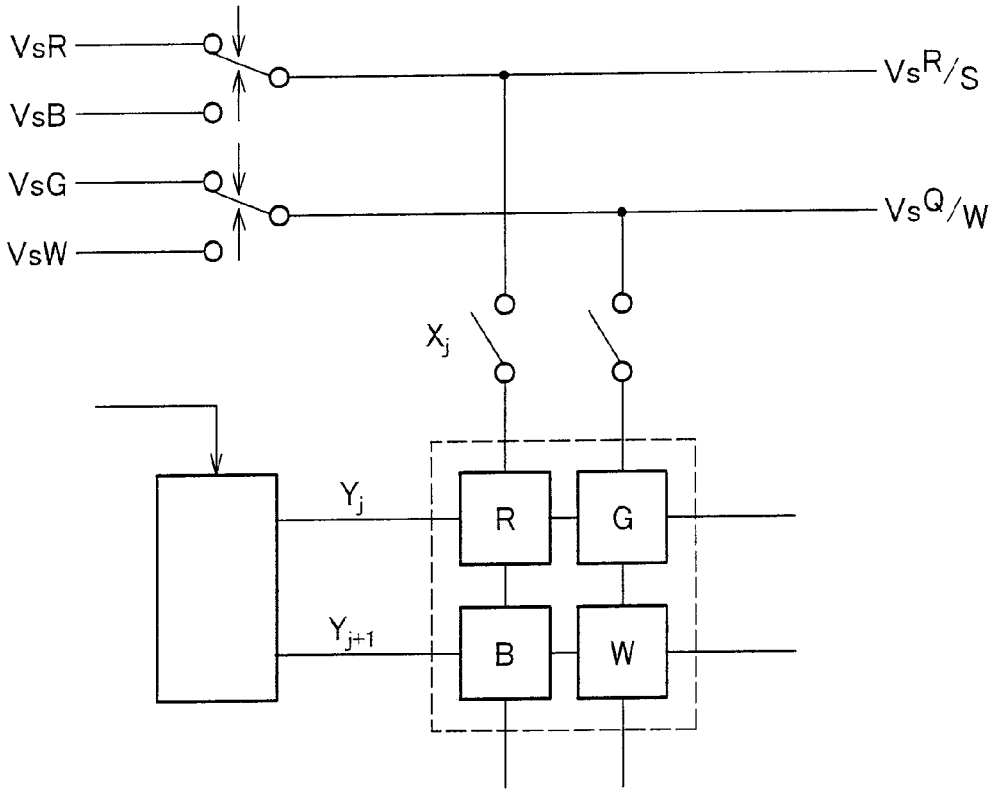
FIG. 17 PRIOR ART
FIG. 17 is a plan view illustrating color filters provided corresponding to the conventional sub-pixels of red (R), green (G), and blue (B) arranged in a matrix pattern.
Figure 18:
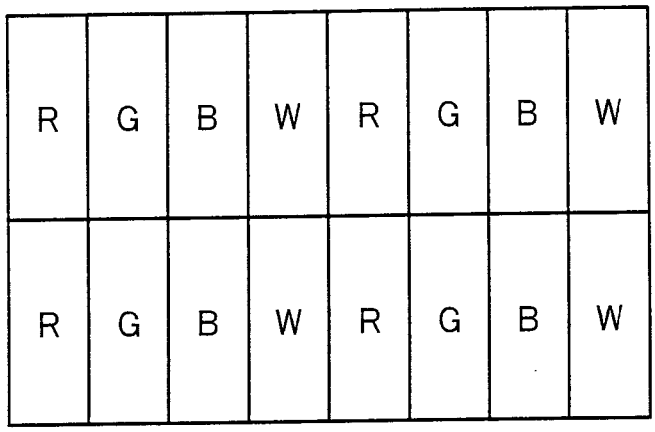
FIG. 18 PRIOR ART
FIG. 18 is a plan view illustrating color filters provided corresponding to the conventional sub-pixels of red (R), green (G), and blue (B) arranged in a strip pattern.
Figure 19:
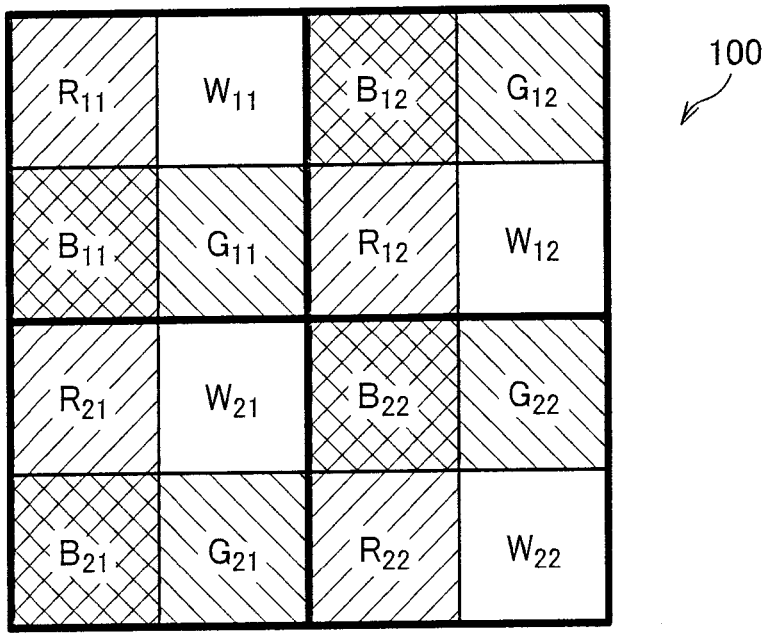
FIG. 19 PRIOR ART
FIG. 19 is a plan view illustrating the arrangement of color filters provided corresponding to four pixels which are combinations of (a) a pixel composed of sub-pixels of red (R), blue (B), green (G), and white (W) in this order counterclockwise and (b) a pixel composed of sub-pixels of blue (B), red (R), white (W), and green (G) in this order counterclockwise.

Next, in the method using Laplacian transformation, as illustrated in FIGS. 11(*a*) through 11(*c*), an original image is decomposed into high frequency image and low frequency image by extracting Laplacian components from the original image. The Laplacian image is considerably correlated to a frequency, so that it is possible to estimate a lower-dimensional (higher-frequency) Laplacian image with relative ease. The estimated high-frequency Laplacian image is combined with a low-frequency image subjected to upsampling to obtain a high-resolution image. The advantage of this method is that pretty good results are obtained even under any given scaling factor. However, the disadvantage thereof is that it takes much time for calculation and many memories are needed.

Other interpolation methods, which have introduced many known algorithms, can be also used in the present preferred embodiment. Thus, an interpolation method can be suitably selected according to a purpose for using a liquid crystal display device and required display performance. Generally, excellent representation of high-frequency components increases image memories and resources associated with calculation such as real number operation. This may result in difficulty in incorporating such resources in a drive circuit. However, it is possible to get a computer, for example, to perform complex calculations. With this, direct input of multicolored image data appropriately processed and the driving device 10 which is able to perform output to a suitable liquid crystal display panel 11, and such combination is provided as a particularly preferred embodiment.

Next, as illustrated in FIG. 5, the luminance converting section 22 receives twofold-interpolated signal from the twofold interpolating section 21, and performs inverse gamma correction to output a luminance ratio of red (R), green (G), and blue (B).

The color adding section 23 adds a luminance ratio of white (W) on the basis of the luminance ratio of red (R), green (G), and blue (B). Such conversion is performed by a method in which respective white components are extracted from binary three-color video signal (R,G,B), and subjected to halftone process to generate a four-color video signal (R,G,B,W). Also, the conversion is performed by a method in which a sum of resulting values obtained for each color by subtractions of a lowest value among increase values of three-color video signals (R,G,B) from the increase values, is used as an input increase value of a white component, and resulting values obtained by subtractions of values for white from the increase values of three-color video signals (R,G,B) are used respectively as output signals of the three-color video signals (R,G,B). The method of converting a three-color video signal (R,G,B) into a four-color video signal (R,G,B,W) is a known technique, and the detailed explanation thereof is omitted in the present preferred embodiment.

Then, the virtual signal generating section 24 relocates luminance signals of the peripheral pixels for each of a color of the color filters.

Finally, the grayscale converting section 25 subjects luminance output of the virtual signal generating section 24 to gamma correction to convert it back into grayscale data. The grayscale data obtained by gamma correction is caused to be displayed on the liquid crystal display panel 11 through the controller 14, the source driver 12, and the gate driver 13, as illustrated in FIG. 4.

This makes it possible to perform display with apparently excellent resolution and with consideration given to luminance balance.

In the present preferred embodiment, the color filters are arranged in one block so as to correspond to four pixels in a matrix pattern of 2-by-2 pixels, each of which is composed of four sub-pixels of red (R), green (G), blue (B), and white (W) in a matrix pattern of 2-by-2 sub-pixels, as illustrated in FIG. 2. However, this is not the only possibility. Alternatively, the following color filters, for example, can be adopted.

That is, examples of the color filters arranged in one block corresponding to one pixel in which sub-pixels are arranged in a matrix pattern of 2-by-2 sub-pixels include: color filters provided corresponding to sub-pixels of red (R), green (G), blue (B), and yellow (Y) as illustrated in FIG. 12(*a*); color filters provided corresponding to sub-pixels of red (R), green (G), blue (B), and cyan (CN) as illustrated in FIG. 13(*a*); and color filters provided corresponding to sub-pixels of red (R), green (G), blue (B), and magenta (M) as illustrated in FIG. 14(*a*). It is to be noted that white balance changes if white (W) is replaced by other color. It is therefore preferable to control color of a backlight for effective use of luminance. For example, if white (W) is replaced by yellow (Y), a blue backlight is used. Replacement of white (W) by magenta (M) produces little effect for improving brightness.

Here, as at least one other color added to red (R), green (G), and blue (B), white (W) is most preferably used in terms of brightness improvement effect. However, in terms of enhancement in color reproduction of halftone colors and control of luminance balance in a pixel, it is sufficiently possible to add a color other than white (W). In this case, white balance and displayable color varies depending on a color added. In order to compensate for the variations, it is preferable to change color tone of a backlight for control of brightness and darkness in colors of the color filters. Note that in the present preferred embodiment, output grayscale calculation is performed including the above controls.

Further, color filters arranged in one block corresponding to one pixel in which sub-pixels are arranged in a matrix pattern of 2-by-3 sub-pixels may be color filters provided corresponding to sub-pixels of red (R), green (G), and blue (B), yellow (Y), white (W), and cyan (CN), as illustrated in FIGS. 15(*a*) through 15(*f*), for example.

Four pixels in a matrix pattern of 2-by-2 pixels in one block, each of which pixel is composed of four sub-pixels of red (R), green (G), blue (B), and white (W), may be arranged as illustrated in FIG. 12(*b*), FIG. 13(*b*), or FIG. 14(*b*), for example. Note that in a matrix pattern of 2-by-2 pixels in one block, each of the four pixels may be the one illustrated in FIG. 12(*a*), FIG. 13(*a*), or FIG. 14(*a*).

Four pixels arranged in a matrix pattern of 2-by-2 pixels in one block, each of which is composed of sub-pixels of red (R), green (G), blue (B), yellow (Y), white (W), cyan (CN), may be arranged as illustrated in any of FIG. 16(*a*) through FIG. 16(*f*), for example. In this case, in terms of resolution, the arrangement illustrated in FIG. 16(*b*) is more preferable to that illustrated in FIG. 16(*a*). The arrangement illustrated in FIG. 16(*d*) is more preferable to that illustrated in FIG. 16(*c*). The arrangement illustrated in FIG. 16(*f*) is more preferable to that illustrated in FIG. 16(*e*). The arrangements illustrated in FIGS. 16(*c*) and 16(*e*) are more preferable to that illustrated in FIG. 16(*a*) in terms of balance of luminance center. The arrangements illustrated in FIGS. 16(*d*) and 16(*f*) are more preferable to that illustrated in FIG. 16(*b*) in terms of balance of luminance center. The arrangements illustrated in FIGS. 16(*c*) and 16(*e*) are different in that whether desirable red color is provided in a vertical direction or in a horizontal direction. The arrangements illustrated in FIGS. 16(*d*) and 16(*f*) are also different in a like manner. Further, mirrored image patterns of these arrangements are also included in the present preferred embodiment.

Thus, in (i) a display panel driving device in the present preferred embodiment, (ii) a display device including the driving device, (iii) a method for driving a display panel, one pixel composed of sub-pixels of red (R), green (G), blue (B), and at least one other color has a plurality of sub-pixels in at least vertical scanning direction, and color filters are provided corresponding to the sub-pixels.

The present preferred embodiment preferably includes the twofold interpolating section 21 which interpolates each of the pixels based on incoming color signal components of red (R), green (G), and blue (B) at least in the vertical scanning direction; the luminance converting section 22 which converts color signals of the interpolated sub-pixels, which are obtained from the twofold interpolating section 21 into luminance signals; the color adding section 23 which adds a color signal component of at least one other color on the basis of the color signal components of red (R), green (G), and blue (B), which are outputted from the luminance converting section 22; and the virtual signal generating section 24 which reallocates luminance signals of the peripheral interpolated sub-pixels for a color of each of the color filters corresponding to the sub-pixels, in accordance with output from the color adding section 23.

With this arrangement, the twofold interpolating section 21 interpolates each of the pixels based on incoming color signal components of red (R), green (G), and blue (B) at least in the vertical scanning direction. This improves resolution.

The luminance converting section 22 converts color signals of the interpolated sub-pixels, which are obtained from the twofold interpolating section 21, into luminance signals. Further, the color adding section 23 adds a color signal component of at least one other color on the basis of the color signal components of red (R), green (G), and blue (B), which are outputted from the luminance signal converting section.

Here, the present preferred embodiment has virtual interpolated color spaces for the color signals of the interpolated sub-pixels in performing signal processing. The present preferred embodiment is arranged such that one pixel composed of sub-pixels of red (R), green (G), blue (B), and at least one other color has a plurality of sub-pixels at least in the vertical scanning direction, and the color filters are provided corresponding to the sub-pixels.

This creates a problem of how to allocate the color signals of the interpolated sub-pixels for display to the color filters corresponding to the sub-pixels. The present preferred embodiment solves this problem by providing the virtual signal generating section 24. The virtual signal generating section 24 reallocates the luminance signals of the peripheral interpolated sub-pixels for a color of each of the color filters corresponding to the sub-pixels, in accordance with output from the color adding section 23.

As a result of this, it is possible to display the color signals of the interpolated sub-pixels for a color of each of the color filters corresponding to the sub-pixels.

Thus, it is possible to provide (i) a driving device 10 for a display panel 11 which is capable of subjecting video signals to signal processing preferably via software for suitable display in order to improve resolution without changing the current arrangement of color filters, (ii) a liquid crystal display device including the driving device 10, and (iii) a method for driving a display panel.

The present preferred embodiment assumes that one pixel composed of sub-pixels of red (R), green (G), blue (B), and at least one other color has a plurality of sub-pixels at least in the vertical scanning direction for the following reason. That is, in the case of stripe-type layout pattern, for example, it remains a stripe-type layout pattern even when interpolated in the vertical scanning direction. This produces no resolution improvement effect, which is caused by representation of interpolated sub-pixels. More specifically, there is the fact that the stripe structure causes all the foregoing problems, but no solution to the problems caused by the stripe structure lies because there is only one-to-one correspondence for sub-pixels at least in the vertical direction between before and after the interpolation.

In the driving device 10 for the liquid crystal display panel 11 of the present preferred embodiment, the color filters are provided respectively corresponding to even-numbered kinds of sub-pixels per pixel. That is, although incoming signals are in forms of three colors of red (R), green (G), and blue (B), it is possible to improve luminance by addition of a color such as white (W).

For this improvement in luminance, in the present preferred embodiment, a pixel is composed of even-numbered kinds of sub-pixels, as sub-pixels for improvement in luminance based on the assumption that one pixel has a plurality of sub-pixels at least in the vertical scanning direction.

In a case where color filters are provided corresponding to a plurality of sub-pixels arranged in a matrix pattern of 2-by-2 sub-pixels per pixel, the driving device 10 for the liquid crystal display panel 11 of the present preferred embodiment subjects video signals to signal processing preferably via software for the improvement in resolution without change of the current arrangement of color filters, so as to provide the liquid crystal display panel 11 which is capable of performing a suitable display.

In a case where color filters are provided corresponding to the sub-pixels of red (R), green (G), blue (B), and white (W) arranged in a matrix pattern of 2-by-2 sub-pixels per pixel, the driving device 10 for the liquid crystal display panel 11 of the present preferred embodiment subjects video signals to signal processing preferably via software without change of the current arrangement of color filters, so as to provide a display panel which can improve resolution.

Addition of a sub-pixel of white (W) is commonly performed for the improvement in luminance. In such a common arrangement in a matrix pattern of 2-by-2 sub-pixels, video signals are subjected to signal processing preferably via software for the improvement in resolution without change of the current arrangement of color filters, so that the liquid crystal display panel 11 which is capable of performing a suitable display is provided. This realizes wide range of applications of the liquid crystal display panel 11.

In a case where color filters are provided corresponding to the sub-pixels of red (R), green (G), blue (B), and yellow (Y) arranged in a matrix pattern of 2-by-2 sub-pixels per pixel, the driving device 10 for the liquid crystal display panel 11 of the present embodiment subjects video signals to signal processing preferably via software for the improvement in resolution without change of the current arrangement of color filters, so as to provide the display panel liquid crystal display panel 11 which is capable of performing a suitable display.

In a case where color filters are provided corresponding to the sub-pixels of red (R), green (G), blue (B), and cyan (CN) arranged in a matrix pattern of 2-by-2 sub-pixels per pixel, the driving device 10 for the liquid crystal display panel 11 of the present preferred embodiment subjects video signals to signal processing preferably via software for the improvement in resolution without change of the current arrangement of color filters, so as to provide the liquid crystal display panel 11 which is capable of performing a suitable display.

In a case where color filters are provided respectively corresponding to even-numbered kinds of sub-pixels per pixel, i.e. red (R), green (G), blue (B), white (W), yellow (Y), blue (B), and cyan (CN) arranged in a matrix pattern of 2-by-3 sub-pixels, video signals are subjected to signal processing preferably via software for the improvement in resolution without change of the current arrangement of color filters, so that it is possible to provide the liquid crystal display panel 11 which is capable of performing a suitable display.

In the driving device 10 for the liquid crystal display panel 11 of the present preferred embodiment, it is possible to secure a spacial resolution with consideration given to luminance balance by using color filters corresponding to four pixels arranged in a matrix pattern of 2-by-2 pixels per block.

In the driving device 10 for the liquid crystal display panel 11 of the present preferred embodiment, it is possible to provide color filters which secure a spacial resolution with consideration given to a specific luminance balance by forming the color filters in such a manner that the four pixels per block are combinations of (a) a pixel composed of sub-pixels of red (R), blue (B), green (G), and white (W) in this order counterclockwise and (b) a pixel composed of sub-pixels of blue (B), red (R), white (W), and green (G) in this order counterclockwise.

In the driving device 10 for the liquid crystal display panel 11 of the present preferred embodiment, the twofold interpolating section 21 interpolates each of the pixels twofold at least in the vertical scanning direction. More specifically, the number of effective scanning lines of a typical television is currently 480, whereas the number of effective scanning lines of a digital high-definition television is 1080. Under the circumstances, it is possible to provide a high-definition display by performing twofold interpolation at least in the vertical scanning direction.

In the liquid crystal display device of the present preferred embodiment, twofold interpolation is performed by a linear interpolation method, a convolution interpolation method, a cosine transformation method, a method using Fourier transformation, a method using Laplacian transformation, or any combination of these methods. This makes it possible to perform a suitable interpolation.

The liquid crystal display device of the present preferred embodiment includes the driving device 10 for the liquid crystal display panel 11. This makes it possible to provide a display device including the driving device 10 for the liquid crystal display panel 11, which display device subjects video signals to signal processing preferably via software for the improvement in resolution without change of the current arrangement of color filters, so as to be able to perform a suitable display.

The display device of the present preferred embodiment has a liquid crystal display element as a display element. This makes it possible to provide a liquid crystal display device including the driving device 10 for the liquid crystal display panel 11, which display device subjects video signals to signal processing preferably via software for the improvement in resolution without change of the current arrangement of color filters, so as to be able to perform a suitable display.

Note that in the present preferred embodiment, the color filter 1 may be provided on either the TFT (Thin Film Transistor) substrate side or the counter substrate side of the liquid crystal display device.

The sections and the process steps of the driving device 10 for the liquid crystal display panel 11 of the present preferred embodiment are realized by a CPU or other computing devices executing a program contained in a ROM (Read Only Memory), a RAM, or other storage devices to control input devices such as a keyboard, an output device such as a display, or communications devices such as an interface circuit. If only a computer having these elements reads a storage medium containing the program and executes the program, it is possible to realize various functions and various processes of the driving device 10 for the liquid crystal display panel 11 of the present preferred embodiment. Further, by storing the program in a removable storage medium, it is possible to realize the various functions and various processes on any computer.

The storage medium may be a memory (not shown) for process steps on a microcomputer. For example, the program medium may be something like a ROM. Alternatively, the program medium may be such that a program reader device (not shown) as an external storage device may be provided in which a storage medium is inserted for reading.

In addition, in any case, the stored program is preferably executable on access by a microprocessor. Further, it is preferred if the program is retrieved, and the retrieved program is downloaded to a program storage area in a microcomputer to execute the program. The download program is stored in a main body device in advance.

In addition, the program medium may be a storage medium constructed separately from a main body. The medium may be tape based, such as a magnetic tape or cassette tape; disc based, such as a flexible disc or hard disk including a magnetic disc and CD/MO/MD/DVD; card based, such as an IC card (including a memory card); or a semiconductor memory, such as a mask ROM, EPROM (Erasable Programmable Read Only Memory), EEPROM (Electrically Erasable Programmable Read Only Memory), and a flash ROM. All these types of media hold the program in a fixed manner.

In contrast, if the system is arranged to connect to the Internet or another communication network, the medium is preferably a storage medium which holds the program in a flowing manner so that the program can be downloaded over the communication network.

Further, if the program is downloaded over a communication network in this manner, it is preferred if the download program is either stored in a main body device in advance or installed from another storage medium.

Further, the driving device 10 for the liquid crystal display panel 11 of the present preferred embodiment is able to receive pixel data containing multicolor information obtained by executing the above-mentioned display panel driving program, and output the pixel data to the corresponding display panel. This makes it possible to receive pixel data containing multicolor information obtained by executing the display panel driving program and output the pixel data to the corresponding display panel.

As described above, in a driving device for display panel and a method for driving a display panel according to preferred embodiments of the present invention, for example, incoming signals RGB signals are interpolated at least vertically to generate interpolated RGB signals on a display panel having color filters of red (R), green (G), blue (B), and white (W). Then, the interpolated RGB signals are converted into interpolated sub-pixel RGBW signals corresponding to the locations of the sub-pixels. Thereafter, the interpolated sub-pixel RGBW signals are reallocated to interpolated sub-pixel RGBW signals actually located.

Further, in a driving device for a display panel and a method for driving a display panel according to preferred embodiments of the present invention, the luminance signal for the color of the interpolated sub-pixel varies depending upon luminance signals of adjacent interpolated sub-pixels of the same color, which sub-pixels exist on upper and lower sides and left and right sides.

In a driving device for a display panel according to preferred embodiments of the present invention, the luminance reallocating section performs reallocation for a color luminance signal D of an interpolated sub-pixel (m,n) in m rows (m is positive integer of not less than 2) and in n columns (n is positive integer of not less than 2), in accordance with a color luminance signal D of an interpolated sub-pixel (m−1, n), a color luminance signal D of an interpolated sub-pixel (m+1,n), a color luminance signal D of an interpolated sub-pixel (m,n−1), and a color luminance signal D of an interpolated sub-pixel (m,n+1).

In a method for driving a display panel according to preferred embodiments of the present invention, the luminance reallocating step is a step of performing reallocation for a color luminance signal D of an interpolated sub-pixel (m,n) in m rows (m is positive integer of not less than 2) and in n columns (n is positive integer of not less than 2), in accordance with a color luminance signal D of an interpolated sub-pixel (m−1,n), a color luminance signal D of an interpolated sub-pixel (m+1,n), a color luminance signal D of an interpolated sub-pixel (m,n−1), and a color luminance signal D of an interpolated sub-pixel (m,n+1).

In preferred embodiments of the present invention, it is assumed that a pixel composed of sub-pixels of red (R), green (G), blue (B), and at least one other color has a plurality of sub-pixels at least in the vertical scanning direction for the following reason. That is, in the case of stripe-type layout pattern, for example, it remains a stripe-type layout pattern even when interpolated in the vertical scanning direction. This produces no resolution improvement effect, which is caused by representation of interpolated sub-pixels. More specifically, there is the fact that the stripe structure causes all the foregoing problems, but no solution to the problems caused by the stripe structure lies because there is only one-to-one correspondence for sub-pixels at least in the vertical direction between before and after the interpolation.

The driving device for a display panel according to preferred embodiments of the present invention is the above driving device for the display panel, such that the color filters are provided respectively corresponding to even-numbered kinds of sub-pixels per pixel.

According to preferred embodiments of the above-described invention, the color filters are provided respectively corresponding to even-numbered kinds of sub-pixels per pixel. More specifically, although incoming signals are in forms of three colors of red (R), green (G), and blue (B), it is possible to improve luminance by addition of a color.

For this improvement in luminance, in preferred embodiments of the present invention, one pixel is preferably composed of even-numbered kinds of sub-pixels. More specifically, it is preferable that one pixel is composed of even-numbered kinds of sub-pixels, as sub-pixels for improvement in luminance based on the assumption that one pixel has a plurality of sub-pixels at least in the vertical scanning direction.

Further, the driving device for a display panel according to preferred embodiments of the present invention is the above-described driving device for the display panel, such that the color filters are provided corresponding to a plurality of sub-pixels which are arranged in a matrix pattern of 2-by-2 sub-pixels per pixel.

According to preferred embodiments of the above-described invention, in a case where color filters are provided corresponding to a plurality of sub-pixels arranged in a matrix pattern of 2-by-2 sub-pixels per pixel, it is possible to provide (i) a driving device for a display panel and (ii) a display device including the driving device, both of which subjects video signals to signal processing preferably via software for the improvement in resolution without change of the current arrangement of color filters, so as to be able to perform a suitable display.

Still further, the driving device for a display panel according to preferred embodiments of the present invention is the above driving device for the display panel, such that the color filters are provided corresponding to sub-pixels of red (R), green (G), blue (B), and white (W).

According to preferred embodiments of the present invention, in a case where color filters are provided corresponding to the sub-pixels of red (R), green (G), blue (B), and white (W) arranged in a matrix pattern of 2-by-2 sub-pixels per pixel, video signals are subjected to signal processing preferably via software without change of the current arrangement of the color filters, so as to provide a display panel which can improve resolution. Addition of a sub-pixel of white (W) is commonly performed for the improvement in luminance. In such a common arrangement in a matrix pattern of 2-by-2 sub-pixels per pixel, video signals are subjected to signal processing preferably via software for the improvement in resolution without change of the current arrangement of the color filters, so that the display panel which is capable of performing a suitable display is provided. This realizes wide range of applications of the display panel.

Still further, the driving device for a display panel according to preferred embodiments of the present invention is the above-described driving device for the display panel, such that the color filters are provided corresponding to sub-pixels of red (R), green (G), blue (B), and yellow (Y).

According to preferred embodiments of the above-described invention, in a case where color filters are provided corresponding to the sub-pixels of red (R), green (G), blue (B), and yellow (Y) arranged in a matrix pattern of 2-by-2 sub-pixels per pixel, video signals are subjected to signal processing preferably via software without change of the current arrangement of color filters, so as to provide a display panel which can improve resolution.

Yet further, the driving device for a display panel according to preferred embodiments of the present invention is the above driving device for the display panel, such that the color filters are provided corresponding to sub-pixels of red (R), green (G), blue (B), and cyan (CN).

According to preferred embodiments of the above-described invention, in a case where color filters are provided corresponding to the sub-pixels of red (R), green (G), blue (B), and cyan (CN) arranged in a matrix pattern of 2-by-2 sub-pixels per pixel, video signals are subjected to signal processing preferably via software for the improvement in resolution without change of the current arrangement of the color filters, so as to provide a display panel which is capable of performing a suitable display.

Further, the driving device for a display panel according to preferred embodiments of the present invention is the above driving device for the display panel, such that the color filters are provided corresponding to a plurality of sub-pixels which are arranged in a matrix pattern of 2-by-3 sub-pixels of red (R), green (G), blue (B), white (W), yellow (Y), blue (B), and cyan (CN).

According to preferred embodiments of the above-described invention, in a case where color filters are provided respectively corresponding to even-numbered kinds of sub-pixels per pixel, i.e. red (R), green (G), blue (B), white (W), yellow (Y), blue (B), and cyan (CN) arranged in a matrix pattern of 2-by-3 sub-pixels, video signals are subjected to signal processing preferably via software for the improvement in resolution without change of the current arrangement of color filters, so that it is possible to provide a display panel which is capable of performing a suitable display.

Yet further, the driving device for a display panel according to preferred embodiments of the present invention is the above driving device for the display panel, such that the color filters are provided corresponding to four pixels arranged in a matrix pattern of 2-by-2 pixels per block.

According to preferred embodiments of the above-described invention, it is possible to secure a spacial resolution with consideration given to luminance balance by using color filters corresponding to four pixels arranged in a matrix pattern of 2-by-2 pixels per block.

Further, the driving device for a display panel according to preferred embodiments of the present invention is the above driving device for the display panel, such that the color filters are provided so that the four pixels per block are combinations of (a) a pixel composed of sub-pixels of red (R), blue (B), green (G), and white (W) in this order counterclockwise and (b) a pixel composed of sub-pixels of blue (B), red (R), white (W), and green (G) in this order counterclockwise.

According to preferred embodiments of the above-described invention, it is possible to provide color filters which secure a spacial resolution with consideration given to a specific luminance balance by forming the color filters in such a manner that the four pixels per block are combinations of (a) a pixel composed of sub-pixels of red (R), blue (B), green (G), and white (W) in this order counterclockwise and (b) a pixel composed of sub-pixels of blue (B), red (R), white (W), and green (G) in this order counterclockwise.

Still further, the driving device for a display panel according to preferred embodiments of the present invention is the above driving device for the display panel, such that the incoming signal interpolating section interpolates each of the pixels twofold at least in a vertical scanning direction.

According to preferred embodiments of the above-described invention, the incoming signal interpolating section interpolates each of the pixels twofold at least in the vertical scanning direction. More specifically, the number of effective scanning lines of a typical television is currently 480, whereas the number of effective scanning lines of a digital high-definition television is 1080. Under these circumstances, it is possible to provide a high-definition display by performing twofold interpolation at least in the vertical scanning direction.

Yet further, the driving device for a display panel according to preferred embodiments of the present invention is the above driving device for the display panel, such that the incoming signal interpolating section performs twofold interpolation by a linear interpolation method, a convolution interpolation method, a cosine transformation method, a method using Fourier transformation, a method using Laplacian transformation, or any combination of these methods.

According to preferred embodiments of the above-described invention, twofold interpolation is performed by a linear interpolation method, a convolution interpolation method, a cosine transformation method, a method using Fourier transformation, a method using Laplacian transformation, or any combination of these methods. This makes it possible to perform a suitable interpolation.

In order to solve the above problems, the display device of preferred embodiments of the present invention includes the above-mentioned driving device for the display panel driving device for the display panel.

According to preferred embodiments of the present invention, since the display device includes the above-mentioned driving device for the display panel. This makes it possible to provide a display device including the driving device for the display panel, which display device subjects video signals to signal processing preferably via software for the improvement in resolution without change of the current arrangement of the color filters, so as to be able to perform a suitable display.

The display device of preferred embodiments of the present invention preferably has a liquid crystal display element as a display element.

According to preferred embodiments of the present invention, it is possible to provide (i) a driving device for a display panel and (ii) a liquid crystal display device including the driving device, both of which subjects video signals to signal processing preferably via software for the improvement in resolution without change of the current arrangement of the color filters, so as to be able to perform a suitable display.

In order to solve the above problems, a display panel driving program of preferred embodiments of the present invention is a display panel driving program for operating the above-mentioned driving device for a display panel, and the program causes a computer to function as the incoming signal interpolating section, the luminance signal converting section, color component adding section, and luminance reallocating section.

A computer-readable storage medium of preferred embodiments of the present invention stores the above-mentioned display panel driving program.

According to preferred embodiments of the above invention, it is possible to operate the incoming signal interpolating section, the luminance signal converting section, the color luminance component adding section, and the luminance reallocating section provided in the above-mentioned driving device for a display panel, on a computer via the display panel driving program. Further, by storing the display panel driving program in a computer-readable storage medium, it is possible to execute the display panel driving program on any computer.

Further, the driving device for a display panel according to preferred embodiments of the present invention receives pixel data containing multicolor information obtained by executing the above-mentioned display panel driving program and output the pixel data to the corresponding display panel.

This makes it possible to receive pixel data containing multicolor information obtained by executing the display panel driving program and output the pixel data to the corresponding display panel.

Preferred embodiments of the present invention are applicable to (a) a display element driving device for driving a plurality of display elements and (b) a display device including the display element driving device. More specifically, preferred embodiments of the present invention are applicable to a display device such as active matrix-type liquid crystal display device, electrophoretic migration-type display, a twist ball-type display, a reflective display including a micro prism film, a display including an optical modulation device such as a digital mirror device. In addition, the present invention is applicable to a display including light-emitting elements whose luminous intensity is variable, such as organic electroluminescent element, inorganic organic electroluminescent element, or LED (Light Emitting Diode), field emission display (FED), and a plasma display.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A driving device for a display panel in which a pixel composed of sub-pixels of red (R), green (G), blue (B), and at least one other color has a plurality of sub-pixels at least in a vertical scanning direction, and color filters are provided corresponding to the respective sub-pixels, the driving device comprising:

an incoming signal interpolating section arranged to interpolate each of the sub-pixels based on incoming color signal components of red (R), green (G), and blue (B) at least in a vertical scanning direction to generate interpolated RGB signals;

a luminance signal converting section arranged to convert color signals of interpolated sub-pixels, which are obtained from the incoming signal interpolating section, into luminance signals;

a color luminance component adding section arranged to add a luminance signal component of at least one other color on a basis of luminance signal components of colors of red (R), green (G), and blue (B), which components are outputted from the luminance signal converting section; and a luminance reallocating section which reallocates luminance signals of peripheral interpolated sub-pixels, for a color of each of the color filters corresponding to the sub-pixels, in accordance with output from the color luminance component adding section.

2. The driving device according to claim 1, wherein the luminance signal for the color of the interpolated sub-pixel varies depending upon luminance signals of adjacent interpolated sub-pixels of the same color, which sub-pixels exist on upper and lower sides and left and right sides.

3. The driving device according to claim 1, wherein the luminance reallocating section performs reallocation for a color luminance signal D of an interpolated sub-pixel (m,n) in m rows (m is positive integer of not less than 2) and in n columns (n is positive integer of not less than 2), in accordance with a color luminance signal D of an interpolated sub-pixel (m−1,n), a color luminance signal D of an interpolated sub-pixel (m+1,n), a color luminance signal D of an interpolated sub-pixel (m,n−1), and a color luminance signal D of an interpolated sub-pixel (m,n+1).

4. The driving device according to claim 1, wherein the color filters are provided respectively corresponding to even-numbered kinds of sub-pixels per pixel.

5. The driving device according to claim 2, wherein the color filters are provided respectively corresponding to a plurality of sub-pixels which are arranged in a matrix pattern of 2-by-2 sub-pixels per pixel.

6. The driving device according to claim 5, wherein the color filters are provided respectively corresponding to the sub-pixels of red (R), green (G), blue (B), and white (W).

7. The driving device according to claim 5, wherein the color filters are provided respectively corresponding to the sub-pixels of red (R), green (G), blue (B), and yellow (Y).

8. The driving device according to claim 5, wherein the color filters are provided respectively corresponding to the sub-pixels of red (R), green (G), blue (B), and cyan (CN).

9. The driving device according to claim 4, wherein the color filters are provided respectively corresponding to a plurality of the sub-pixels which are arranged in a matrix pattern of 2-by-3 sub-pixels of red (R), green (G), blue (B), white (W), yellow (Y), blue (B), and cyan (CN).

10. The driving device according to claim 4, wherein the color filters are provided respectively corresponding to four pixels arranged in a matrix pattern of 2-by-2 pixels per block.

11. The driving device according to claim 4, wherein the color filters are arranged such that the four pixels per block are combinations of (a) a pixel including sub-pixels of red (R), blue (B), green (G), and white (W) in this order counterclockwise and (b) a pixel composed of sub-pixels of blue (B), red (R), white (W), and green (G) in this order counterclockwise.

12. The driving device according to claim 1, wherein the incoming signal interpolating section interpolates the sub-pixels twofold at least in a vertical scanning direction.

13. The driving device according to claim 12, wherein the incoming signal interpolating section performs twofold interpolation by a linear interpolation method, a convolution interpolation method, a cosine transformation method, a method using Fourier transformation, a method using Laplacian transformation, or any combination of these methods.

14. A display device including a driving device for a display panel in which a pixel including sub-pixels of red (R), green (G), blue (B), and at least one other color has a plurality of sub-pixels at least in a vertical scanning direction, and color filters are provided corresponding to the respective sub-pixels, the driving device comprising:

an incoming signal interpolating section arranged to interpolate each of sub-pixels based on incoming color signal components of red (R), green (G), and blue (B) at least in a vertical scanning direction to generate interpolated RGB signals;

a luminance signal converting section which converts color signals of interpolated sub-pixels, which are obtained from the incoming signal interpolating section, into luminance signals;

a color luminance component adding section arranged to add a luminance signal component of at least one other color on a basis of luminance signal components of colors of red (R), green (G), and blue (B), which components are outputted from the luminance signal converting section; and a luminance reallocating section which reallocates luminance signals of peripheral interpolated sub-pixels, for a color of each of the color filters corresponding to the sub-pixels, in accordance with output from the color luminance component adding section.

15. The display device according to claim 14, wherein in the driving device for a display panel, the luminance signal for the color of the interpolated sub-pixel varies depending upon luminance signals of adjacent interpolated sub-pixels of the same color, which sub-pixels exist on upper and lower sides and left and right sides.

16. The display device according to claim 15, wherein the luminance reallocating section of the driving device for a display panel performs reallocation for a color luminance signal D of an interpolated sub-pixel (m,n) in m rows (m is positive integer of not less than 2) and in n columns (n is positive integer of not less than 2), in accordance with a color luminance signal D of an interpolated sub-pixel (m−1,n), a color luminance signal D of an interpolated sub-pixel (m+1,n), a color luminance signal D of an interpolated sub-pixel (m,n−1), and a color luminance signal D of an interpolated sub-pixel (m,n+1).

17. The display device according to claim 14, wherein the display device has a liquid crystal display element as a display element.

18. A method for driving a display panel in which a pixel including sub-pixels of red (R), green (G), blue (B), and at least one other color has a plurality of sub-pixels at least in a vertical scanning direction, and color filters are provided corresponding to the respective sub-pixels, the method comprising:

interpolating each of the sub-pixels based on incoming color signal components of red (R), green (G), and blue (B) at least in a vertical scanning direction to generate interpolated RGB signals;

converting color signals of interpolated sub-pixels, which are obtained in the interpolating step, into luminance signals;

adding a luminance signal component of at least one other color on a basis of luminance signal components of colors of red (R), green (G), and blue (B), which are obtained as the luminance signals in the converting step; and reallocating luminance signals of peripheral interpolated sub-pixels for a color of each of the color filters corresponding to the sub-pixels, after the adding step.

19. The method according to claim 18, wherein the luminance signal for the color of the interpolated sub-pixel varies depending upon luminance signals of adjacent interpolated sub-pixels of the same color, which sub-pixels exist on upper and lower sides and left and right sides.

20. The method according to claim 18, wherein the reallocating step includes a step of performing reallocation for a color luminance signal D of an interpolated sub-pixel (m,n) in m rows (m is positive integer of not less than 2) and in n columns (n is positive integer of not less than 2), in accordance with a color luminance signal D of an interpolated sub-pixel (m−1,n), a color luminance signal D of an interpolated sub-pixel (m+1,n), a color luminance signal D of an interpolated sub-pixel (m,n−1), and a color luminance signal D of an interpolated sub-pixel (m,n+1).

21. A computer-readable storage medium storing a display panel driving program for operating the driving device for a display panel according to claim 1, the program causing a computer to function as the incoming signal interpolating section, the luminance signal converting section, the color luminance component adding section, and the luminance reallocating section.

22. A driving device for a display panel, wherein the driving device receives pixel data containing multicolor information obtained by executing the display panel driving program stored on the computer-readable storage medium according to claim 21, and outputs the pixel data to a corresponding display panel.

* * * * *